US006453976B1

(12) United States Patent
Chandley et al.

(10) Patent No.: US 6,453,976 B1
(45) Date of Patent: Sep. 24, 2002

(54) LOST FOAM COUNTERGRAVITY CASTING

(75) Inventors: George D. Chandley, Amherst; Qi Zhao, Nashua, both of NH (US)

(73) Assignee: Hitchiner Manufacturing Co., Inc., Milford, NH (US)

( * ) Notice: Subject to any disclaimer, the term of this patent is extended or adjusted under 35 U.S.C. 154(b) by 0 days.

(21) Appl. No.: 09/430,652

(22) Filed: Oct. 29, 1999

(51) Int. Cl.[7] ..... B22C 9/04; B22D 18/04

(52) U.S. Cl. ..... 164/34; 164/63; 164/119; 164/306; 164/234; 164/137; 164/341

(58) Field of Search ..... 164/34, 35, 36, 164/63, 119, 225, 306, 175, 234, 137, 341

(56) References Cited

U.S. PATENT DOCUMENTS

| | | | | |
|---|---|---|---|---|
| 3,526,266 A | | 9/1970 | Snelling | 164/349 |
| 3,900,064 A | | 8/1975 | Chandley et al. | 164/51 |
| 4,068,704 A | | 1/1978 | Wittmoser | 164/160 |
| 4,616,689 A | * | 10/1986 | Denis | 164/34 |
| 4,874,029 A | | 10/1989 | Chandley | 164/34 |
| 4,957,153 A | | 9/1990 | Chandley | 164/7.1 |
| 4,958,674 A | | 9/1990 | Bolle | 164/456 |
| 4,971,131 A | | 11/1990 | Aubin et al. | 164/7.1 |
| 5,009,260 A | | 4/1991 | Cleary et al. | 164/255 |
| 5,044,420 A | * | 9/1991 | Vander Jagt | 164/63 |
| 5,062,466 A | | 11/1991 | Kubisch et al. | 164/7.1 |
| 5,062,467 A | | 11/1991 | Kubisch et al. | 164/7.1 |
| 5,069,271 A | | 12/1991 | Chandley et al. | 164/516 |
| 5,113,924 A | | 5/1992 | Green et al. | 164/63 |

FOREIGN PATENT DOCUMENTS

| | | | |
|---|---|---|---|
| DE | 476415 | * 3/1929 | 164/175 |
| DE | 2916465 | * 11/1980 | 164/234 |

* cited by examiner

*Primary Examiner*—Tom Dunn
*Assistant Examiner*—I.-H. Lin

(57) ABSTRACT

A vaporizable refractory coated pattern assembly is formed having a sprue connected to a plurality of thin wall patterns of articles to be cast. The pattern assembly is supported in a refractory particulate media in an open bottom container that is evacuated to subambient pressure and rotated in a manner to distribute particulates to regions of the refractory coated patterns not yet directly contacted by particulates. The pattern assembly is comprised of relatively dense foam plastic pattern material that imparts increased strength to the thin wall patterns. The sprue includes a vent passage that communicates to a particulate media to vent pattern decomposition vapors thereto in a manner that enables faster replacement of the pattern assembly in the media, despite the use of the relatively dense pattern material.

20 Claims, 6 Drawing Sheets

L
12a
12
14
42
40a
30
48
16
40
70
A
RR
20
RR
22a
41
22
60
60a
60b
60c
40b
22b

LOST FOAM COUNTERGRAVITY CASTING

FIELD OF THE INVENTION

The present invention relates to lost foam countergravity casting of metals and alloys.

BACKGROUND OF THE INVENTION

Countergravity casting processes for making investment castings in ceramic molds are described in U.S. Pat. No. 3 900 064 and 5 069 271. The patents involve using wax patterns of the castings to be made in the well known lost wax process to make a gas permeable investment shell mold by the well known lost wax technique. The casting processes include vacuuming molten metal upwardly into a vertical central sprue of the gas permeable mold from an underlying molten metal pool with the sprue sized to permit the castings to solidify while the molten metal in the sprue remains unsolidified for return to the pool for reuse in manufacture of further castings, thereby reducing cost of manufacture.

The well known lost foam casting process involves pouring molten metal into a vaporizable, foamed plastic pattern surrounded by an unbonded foundry sand support media in a container. The molten metal destroys and replaces the plastic pattern before the unbonded sand collapses and produces a casting having the shape of the pattern. The lost foam process was extended by U.S. Pat. No 4 874 029 to provide for countergravity casting of much thinner castings at lower cost than achievable by pouring molten metal into foam plastic patterns. In these lost foam processes, the container for the patterns and the foundry sand support media is vibrated, or the foundry sand is optionally fluidized in the container, during filling with sand so as to distribute the sand to all pattern surfaces. However, the vibratory or fluidization forces exerted on the foam plastic patterns can mechanically damage them, especially in the event fragile foam plastic patterns having one or more thin pattern walls are used.

An object of the present invention is to provide a countergravity casting process and apparatus for making cast components using vaporizable patterns in a manner that provides investing of the patterns in a particulate media, such as unbonded foundry sand, while avoiding the need for vibration or fluidization of the particulates.

Another object of the present invention is to provide a countergravity casting process and apparatus for making cast components in a manner that provides faster and more complete replacement of the patterns with molten metal.

Still another object of the present invention is to provide a countergravity casting process and apparatus for making cast components using foam plastic patterns in a manner that permits reuse of molten metal in a sprue.

SUMMARY OF THE INVENTION

In an illustrative method embodiment of the present invention, the patterns of the components to be cast are placed in a container, and refractory particulates are introduced into the container about the patterns. After filling of the container with particulates, the container is evacuated and rotated in a manner to cause movement of the particulates to any regions of the thin wall patterns not yet invested or supported by the particulates. Container rotation can occur about an axis normal to a container longitudinal axis and optionally about another axis, which may include the container longitudinal axis. The container and its contents then are ready for countergravity casting of molten metal into the patterns from a source of molten metal to destroy and replace them in the particulate media.

In accordance with another method embodiment, as the molten metal advances upwardly progressively destroying and replacing the pattern assembly, thermal decomposition vapors of the pattern material are vented through a vent passage in a sprue interconnecting the patterns in a manner that permits faster and more complete replacement of the patterns with the molten metal. After at least partial solidification of the castings, the container typically is moved to disengage from the molten metal source and permit molten metal residing in the sprue to drain by gravity to the source for reuse.

In another illustrative embodiment of the present invention, a vaporizable pattern assembly is formed having a sprue connected to a plurality of thin wall patterns of articles to be cast. The pattern assembly is supported in a refractory particulate media in an open bottom container that can be evacuated to provide subambient pressure therein. The patterns preferably comprise a relatively dense foam plastic pattern material that imparts increased strength to the thin wall patterns. The sprue includes a vent passage that communicates to the particulate media to vent pattern thermal decomposition vapors to the particulate support bed in a manner that enables faster and more complete replacement of the patterns with molten metal in the support media, despite use of a relatively dense pattern material.

Advantages and objects of the present invention will be better understood from the following detailed description of the invention taken with the following drawings.

DESCRIPTION OF THE INVENTION

The present invention provides a method and apparatus for countergravity casting metallic components of myriad types, such as, for example only, internal combustion engine intake and exhaust manifolds, valves, cam shafts, rocker arms, and other components, using a wide variety of metals and alloys where the terminology "metal" as used herein is intended to include metals and alloys. Such metals and alloys include, but are not limited to, iron, steel, stainless steel, aluminum, nickel alloys and others.

Figure 1:
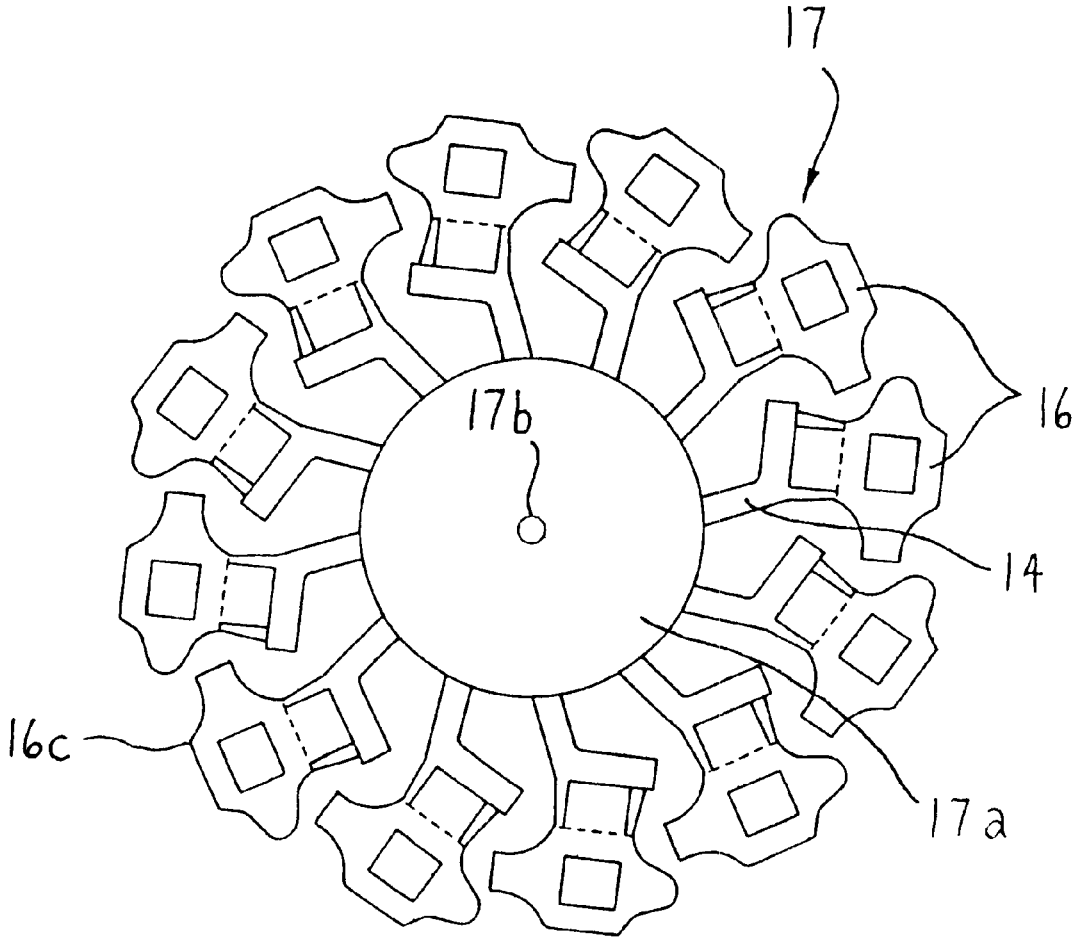
FIG. 1 is a plan view of a molded foam plastic ring having a sprue disk connected by runners to a plurality thin wall rocker arm patterns.
Figure 2:
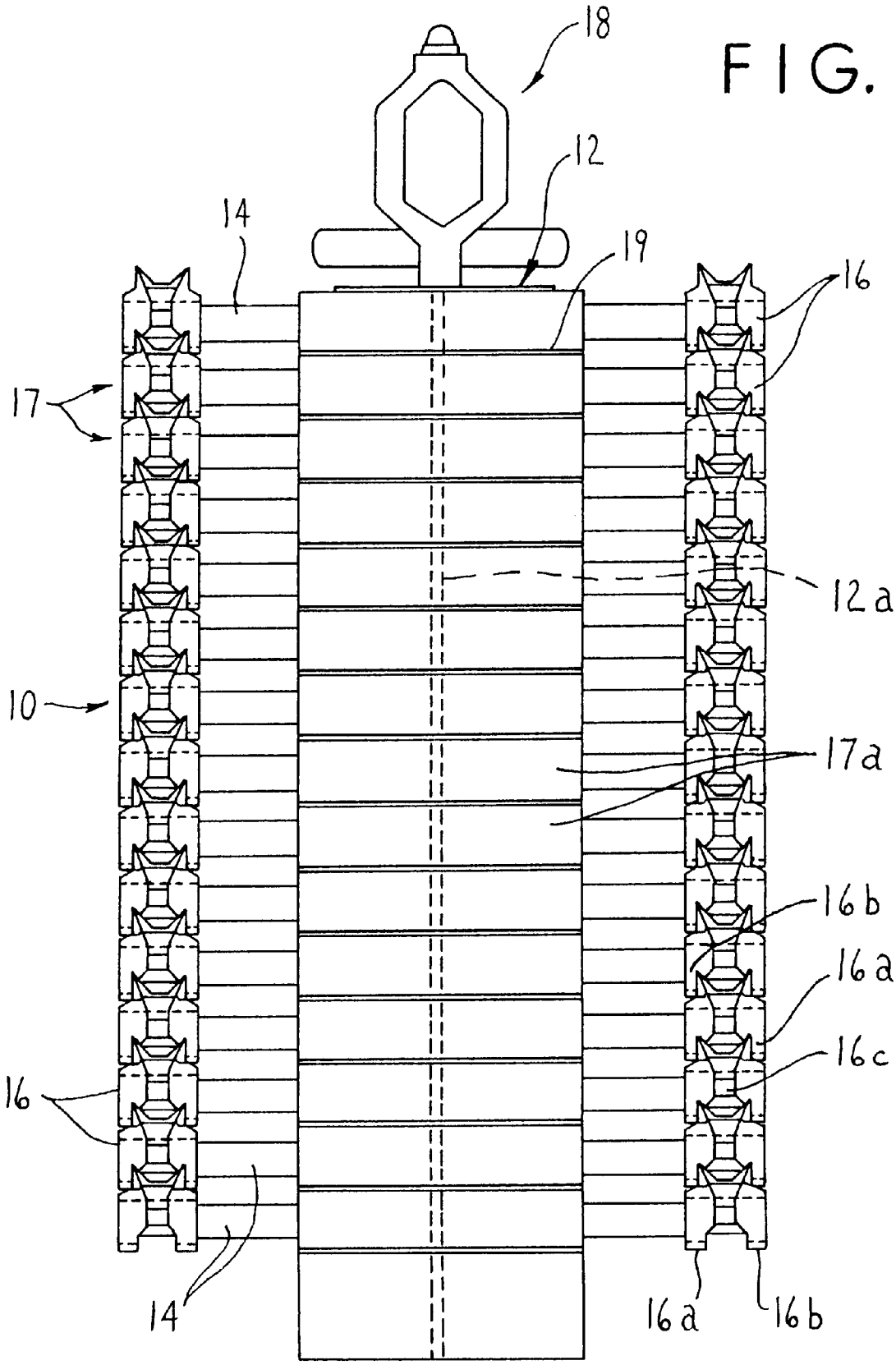
FIG. 2 is an elevational view of a plurality of molded foam plastic rings of FIG. 1 adhered together one atop the other to form a pattern assembly.

For purposes of illustration and not limitation, the invention will be described with respect to countergravity casting rocker arms which are used in internal combustion engines and which typically have a pair of thin cast sidewalls. For example, a rocker arm countergravity cast pursuant to the invention as described below typically includes first and second laterally spaced apart depending sidewalls each having a thickness of 0.040–0.060 inch. Foam plastic (expanded polystyrene) patterns of such rocker arms are fragile and subject to damage as well as being difficult to replace with molten metal as a result of the presence of the thin pattern sidewalls shown as sidewalls 16*a*, 16*b* in FIG. 2.

Referring to FIGS. 1–6, a vaporizable pattern assembly 10 is formed pursuant to an illustrative embodiment of the invention having central pattern sprue 12 connected by gates or runners 14 to a plurality of thin wall rocker arm shaped patterns 16. To this end, each pattern 16 has first and second laterally spaced apart sidewalls 16*a*, 16*b* with a wall thickness nominally of 0.050 inch. The thin sidewalls 16*a*, 16*b* are connected to a main rocker arm body 16*c*.

The pattern assembly 10 is comprised of a plurality of foam plastic pattern rings 17 with each ring having a central sprue disk 17*a* connected to the patterns 16 by respective elongated, narrow gates or runners 14. The sprue disk 17*a* includes a central passage 17*b* extending through the thickness dimension thereof. The pattern rings 17 are stacked one top the other with the sprue disks 17*a* glued together by a suitable adhesive 19, such as hot melt glue adhesive, to form the pattern assembly 10. The disk passages 17*b* are axially aligned and communicated to define a sprue vent passage 12*a* extending along the longitudinal axis of the pattern sprue 12 from one end to the other, FIG. 2.

The pattern rings 17 can be cut from as-received expanded polystyrene plate stock or molded by conventional expanded foam technique using expandable polystyrene beads to provide patterns 16 that exhibit a relatively high foam density of about 1.8 to about 2.2 pounds per cubic foot (as compared to a foam density of 1.2 to 1.6 pounds per cubic foot used heretofore for automotive cylinder head patterns). The higher density foam plastic material imparts improved strength to the thin wall patterns 16. Polystyrene beads that can be used to practice the invention are available as 3749 polystyrene beads from Styrochem, Inc. The present invention is not limited to expanded polystyrene foam pattern materials and can be practiced using other foam plastic materials, such as PMMA (polymetylmethacrylate) and others.

Figure 3:
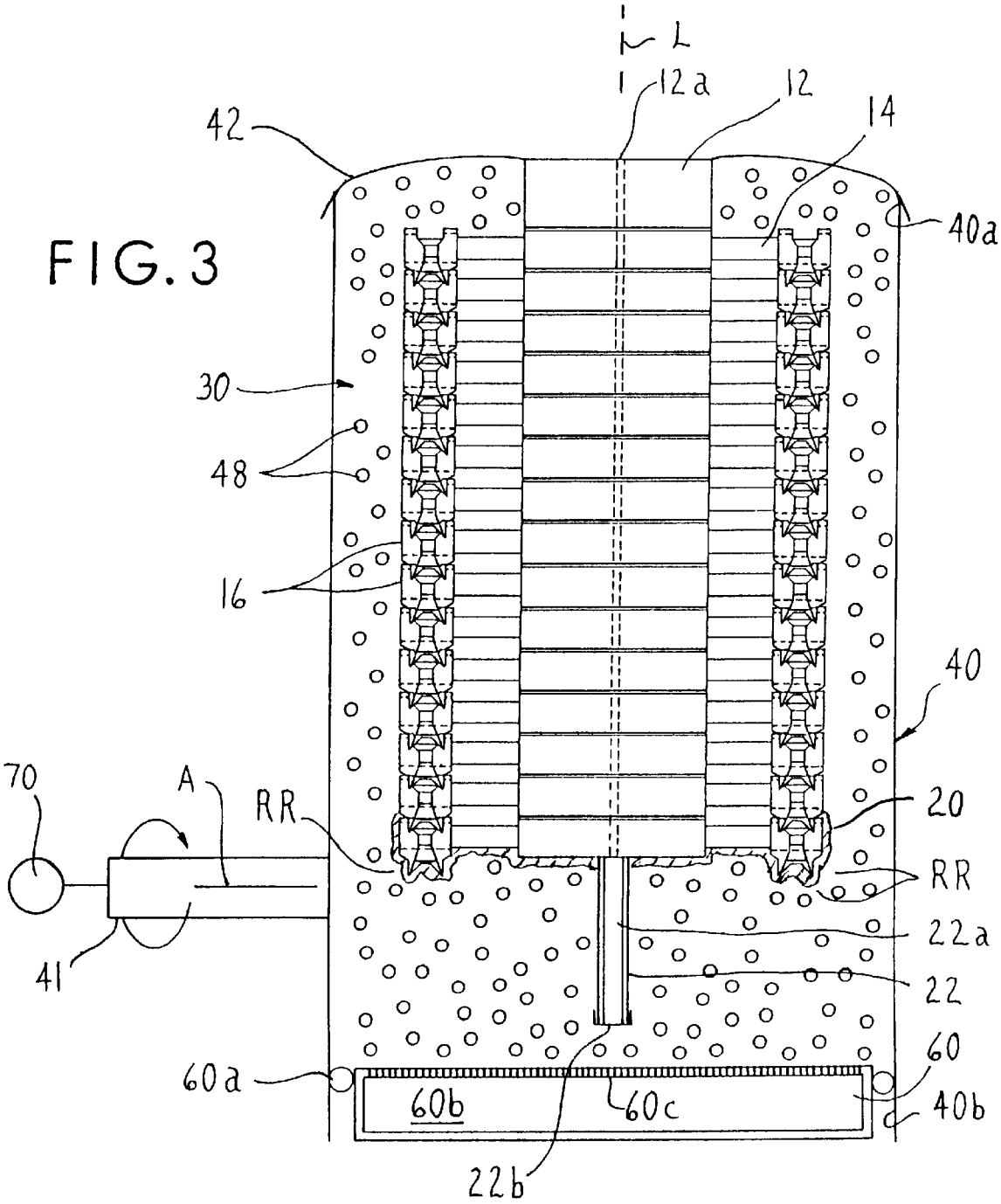
FIG. 3 is a partial sectional view showing the pattern assembly coated with a gas permeable refractory coating invested in unbonded sand media in a container facing upwardly during filling with particulates.
Figure 4:
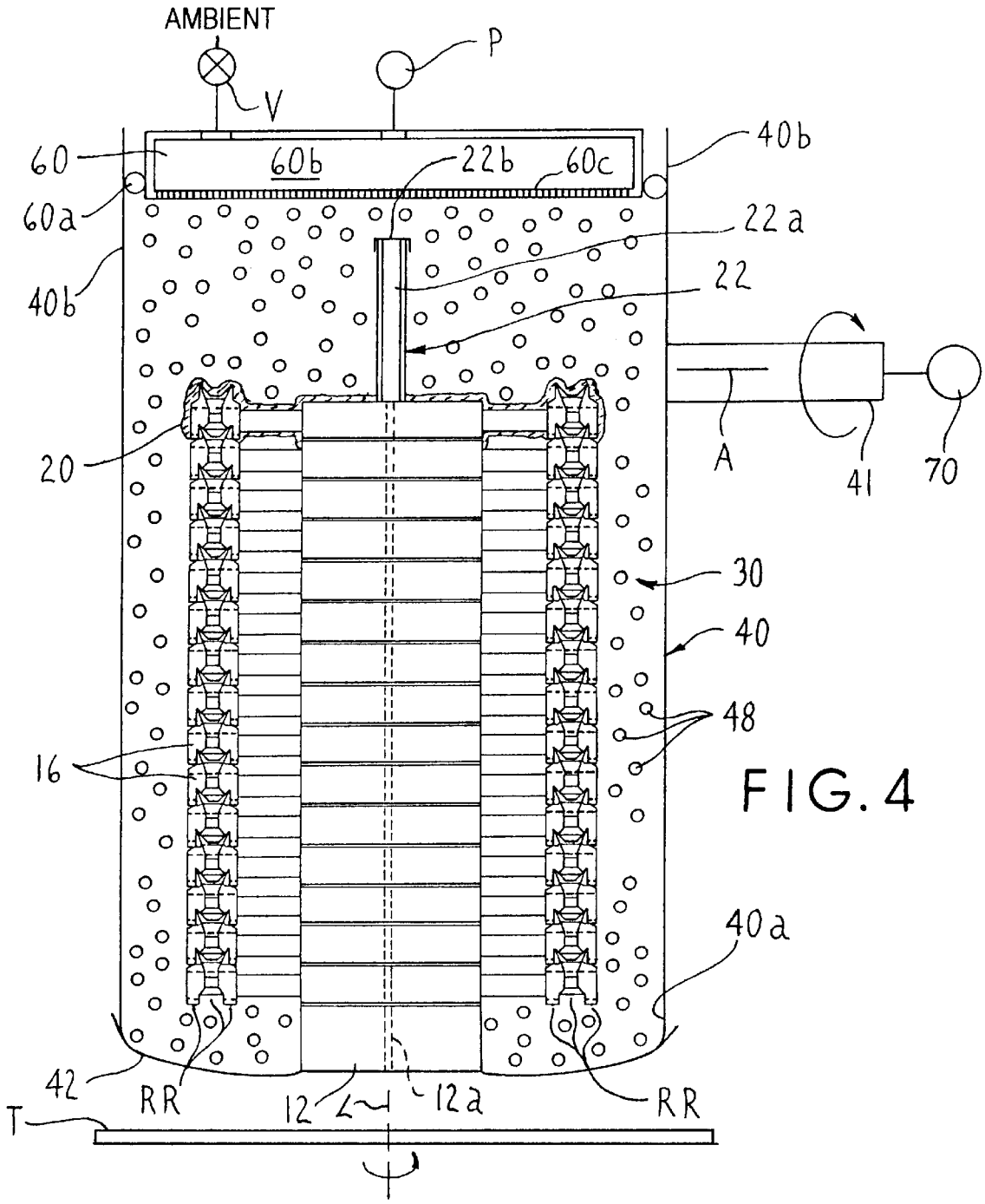
FIG. 4 is a partial sectional view showing the pattern assembly coated with a gas permeable refractory coating invested in unbonded sand media in a container facing downwardly.

The pattern assembly 10 is temporarily provided with a handle 18 adhered to the top of the pattern sprue 12 and by which the pattern assembly 10 can be dipped in a refractory slurry to form a thermally insulative, gas permeable refractory coating 20, shown partially in FIGS. 3 and 4 for convenience, on the exterior surfaces of the pattern assembly 10, leaving internal vent passage 12*a* uncoated. A refractory coating which can be used in practice of the invention is available as Polyshield 3600 available from Borden Chemical Co. This refractory coating comprises mica and quartz refractory material. The coating 20 is applied by dipping the pattern assembly 10 in a slurry of the refractory material using the handle 18, draining excess slurry, and drying the slurry overnight to provide a gas permeable refractory coating on exterior surfaces of the pattern assembly having a thickness in the range of 0.010 to 0.020 inch. The handle 18 is removed from the pattern assembly 10 after the refractory coating 20 is formed thereon.

A vent tube 22 then is attached to the top of the pattern sprue 12, FIG. 3, by adhesive similar to that used to join the sprue disks 17*a* together so that the passage 22*a* of vent tube 22 is axially aligned with and communicates to the sprue vent passage 12*a*. The vent tube 22 can comprise glass material for purposes of illustration only. The vent tube passage 22*a* typically has a larger inner diameter than the sprue vent passage 12*a*. For example only, the vent tube passage 22*a* can have an inner diameter of 0.5 inch, while the sprue vent passage 12*a* can have an inner diameter of 0.1 inch. For another example only, a vent tube passage 22*a* can have an inner diameter of 0.375 inch, and sprue vent passage 12*a* can have an inner diameter of 0.25 inch. The invention is not limited to any particular dimensions for the passages 12*a*, 22*a*. The top of the vent tube 22 includes a gas permeable cap 22*b* adhered thereon made of metal screen to permit venting of decomposition vapors, while preventing support particulates 48 described below from entering the vent tube 22.

In an illustrative method embodiment of the present invention shown in FIG. 3, the container 40 is positioned with its open end 40*a* facing upwardly so that refractory particulates 48 (e.g. unbonded foundry sand of 50 mesh size) can be introduced manually or from a hopper (not shown) to partially fill the container 40. The container 40 has a vacuum head 60 located in the other end 40*b* thereof. The refractory coated pattern assembly 10 then is placed through open end 40*a* into the partially filled container 40, and the remaining volume of the container 40 is filled with the particulates 48 manually or from the hopper to invest the pattern assembly therein as described, for example, in U.S. Pat. No. 4 874 029, the teachings of which are incorporated herein by reference. Filling of the container 40 with particulates 48 is conducted without vibration of the container 40 or fluidization of the particulates 48 therein. Once the container is filled, a thermally destructible closure 42 is placed over the exposed surface or side 30*a* of the particulates media 30 formed in the container 40 by particulates 48. The thermally destructible closure 42 may comprise aluminum foil or other suitable material that is thermally destroyed (e.g. melted) by the molten metal to be cast into the pattern assembly as described below.

In an alternative embodiment shown in FIG. 4, the container 40 is positioned with its open end 40*a* facing downwardly and resting on thermally destructible member 42 on a support surface such as a table contoured to this end and with the vacuum head 60 removed from container end 40*b*. The refractory coated pattern assembly 10 is placed in container 40 followed by filling the remaining volume of the container with the particulates 48 to form particulate media 30 invested around the pattern assembly 10 in the container 40. Filling of the container 40 with particulates 48 is conducted without vibration of the container 40 or fluidization of the particulates 48 therein. After the container is filled with the particulates, vacuum head 60 is inserted in the end 40*b* of the container above the particulate support media 30.

The vacuum head 60 includes a peripheral vacuum sealing gasket 60*a* in engagement with the inner wall of the container 40 and a vacuum chamber 60*b* defined therein and communicated to the interior of the container 40 by a gas permeable plate 60*c* in the manner described in U.S. Pat. No. 4 874 029 and 5 069 271, the teachings of which are incorporated herein by reference. Vacuum chamber 60*b* is communicated to a vacuum pump P in order to establish a subambient pressure in the vacuum chamber 60*b* and in the container 40 via gas permeable plate 60*c*, which may be a porous ceramic plate or metal screen to prevent particulates 48 from being drawn into the vacuum chamber 60*b*, valve V to ambient being closed.

A subambient pressure is established by vacuum pump P in the vacuum chamber 60*b* and thus in container 40 having the refractory coated pattern assembly 10 surrounded by the refractory particulates media 30 introduced therearound by the particulate filling techniques described above. With the subambient pressure established in vacuum chamber 60*b*, the container 40 is rotated to a desired angular extent about an axis A perpendicular to the longitudinal axis L of the container, FIGS. 3 and 4. For example, a rotary actuator 70 comprised of a hydraulic motor and gear train (not shown) rotates lateral arm 41 connected to the container 40 and defining axis A. The actuator 70 can be part of a robotic arm (not shown) as described in U.S. Pat. No. 4 874 029, the teachings of which are incorporated herein by reference to this end. The container 40 and its contents are rotated to invert or nearly invert the container 40 and its contents to cause movement of the particulates 48 (e.g. unbonded foundry sand) to regions RR of the refractory coated thin wall patterns 16 that remain uncontacted (not invested) by the particulates 48. In FIGS. 3 and 4, these regions RR of the refractory coated patterns 16 typically correspond to the undersides of essentially horizontal pattern surfaces and to recessed regions or pockets on the refractory coated rocker arm shaped patterns 16 where air spaces or pockets may remain.

For purposes of illustration only, a container 40 including foundry sand 48 and a rocker arm pattern assembly 10 weighing a total of 260 pounds can be rotated to an angular extent of 340 degrees (e.g. 170 degrees clockwise with container end 40*a* facing upwardly and then 340 degrees counterclockwise with container end 40*a* facing upwardly) in 15 seconds with a vacuum level of 5 psi in vacuum chamber 60*b* to distribute the foundry sand to as yet uninvested pattern regions where the particulates do not directly contact the refractory coated pattern regions so as to provide full investment of the refractory coated thin wall patterns 16 in the sand media 30 prior to countergravity casting of the molten metal into the pattern assembly 10. Costly and damaging vibration or fluidization of the sand particulates in the container 40 about the patterns 16 is avoided.

Some pattern shapes may require more complicated container motion, for example, where the container 40 and its contents are rotated about axis A to invert or nearly invert the container and its contents as described above. The container 40 then is placed on a rotary table T, FIG. 4, and the subambient pressure is released with the valve V opened to ambient pressure. Rotary table T then is rotated 90 degrees or an appropriate angular extent to rotate the container 40 and its contents about longitudinal axis L of container 40. Then, the subambient pressure is re-established in container 40 by pump P with valve V closed. The container 40 and its contents then are rotated by actuator 70 about axis A as described above to a position such as FIG. 3 followed by return to the position shown in FIG. 4. The sequence of inversion and angular rotation can be repeated as often as desired to cause movement of the particulates 48 to any regions of the refractory coated thin wall patterns not yet invested or contacted thereby. The container 40 and its contents can be rotated on table T before or after rotation about axis A.

The invention envisions rotating the container 40 and its contents to a desired angular extent about an axis other than axis A or longitudinal axis L. For example, in the event a robotic arm is available with suitable rotational flexibility or capability, the container 40 and its contents can be rotated about any desired angle within the capability of the robotic arm to cause movement of the particulates 48 to any regions of the refractory coated thin wall patterns not yet invested or contacted thereby.

Figure 5:
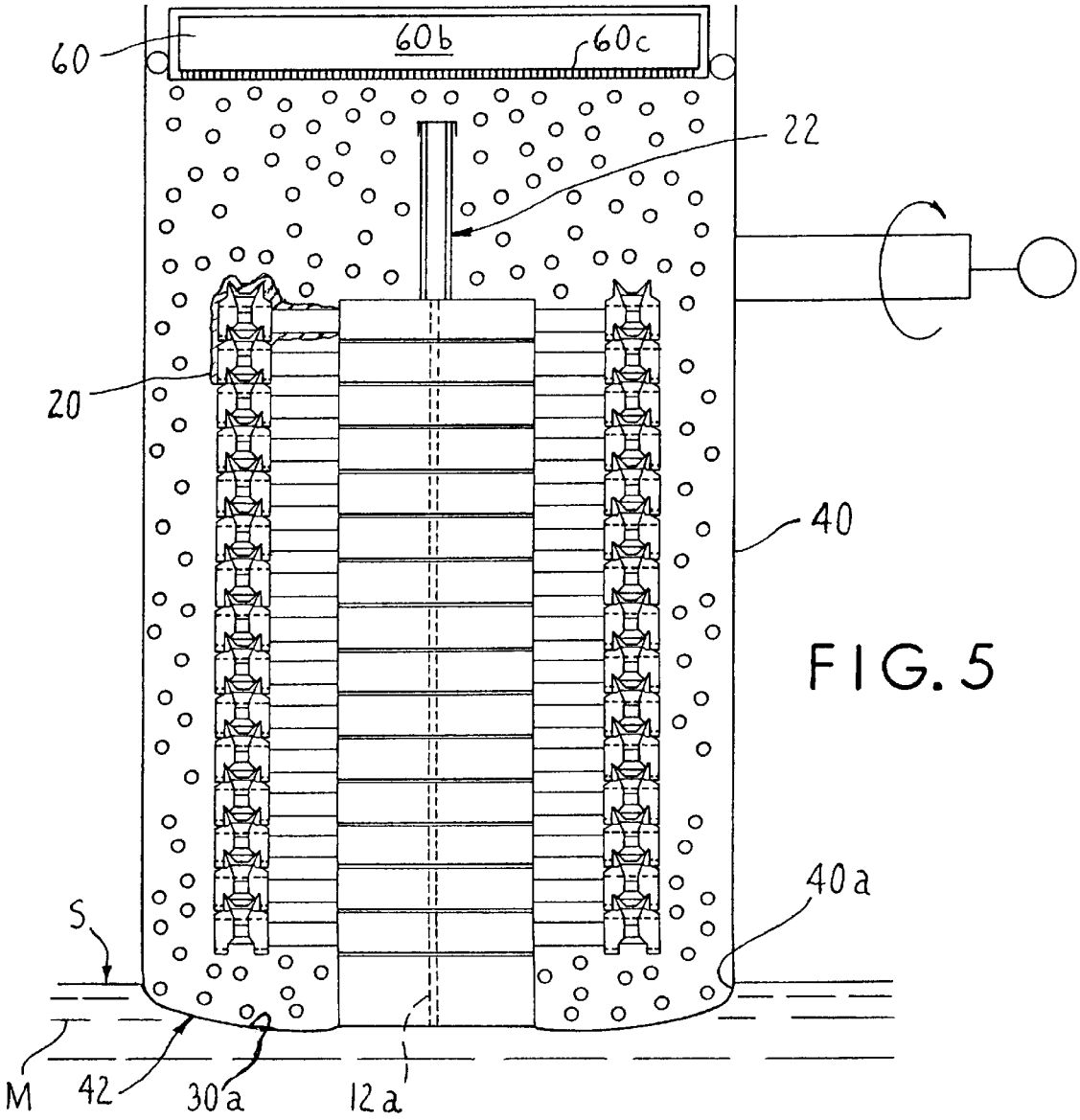
FIG. 5 is a partial sectional view showing the open end of the container of FIG. 4 immersed in a pool of molten metal for countergravity casting.

Referring to FIG. 5, after container rotation described above and with subambient pressure in vacuum chamber 60*b*, the container 40 and an underlying source S of molten metal M (illustrated as a molten metal pool) are relatively moved to immerse the container end 40*a* in the molten metal M. The subambient pressure in the container 40 generates a differential pressure on the particulate media 30 wherein an external pressure (ambient pressure) on side 30*a* of the media 30 exceeds internal pressure in the container to an extent to hold the media 30 and pattern assembly 10 as well molten metal replacing it in the container 10 before, during and after countergravity casting as described in the aforementioned U.S. patents incorporated herein by reference above.

Upon immersion of the container end 40*a* in the molten metal, the closure 42 is melted. The molten metal M is drawn upwardly from the source S into the pattern assembly 10 by virtue of ambient (atmospheric) pressure on the molten metal M and the subambient pressure in the container 40.

The molten metal advances upwardly progressively destroying and replacing the pattern assembly 10. As the molten metal advances, the pattern assembly generates thermal decomposition vapors from the vaporizable pattern material. These thermal decomposition vapors are vented through the sprue vent passage 12*a* in the pattern sprue 12 and vent tube 22 to the support media 30 proximate the gas permeable plate 60*c* to the vacuum chamber 60*b* where the vapors are removed. Without such venting, the back pressure of evaporating pattern material slows metal fill rates into the pattern assembly and causes non-fill and cold lap defects in the thin wall sidewalls 16*a*, 16*b* of the patterns 16. Venting pursuant to the invention provides substantially faster and more complete replacement or filling of the patterns 16 and a reduction in casting defects by virtue of reducing the back pressure of the thermal decomposition vapors from the pattern material.

For example, replacement or filling of the pattern assembly 10 having a large number of patterns 16 (e.g. 120 rocker arm patterns) with molten 8620 or 8640 steel typically occurs in one third the time pursuant to practice of the invention than required to fill a similar pattern assembly without venting (i.e. without sprue vent passage 12*a* and vent tube 22).

For purposes of illustration and not limitation, a vacuum level of 11 psi in chamber 60*c* has been used to hold the foam polystyrene pattern assembly 10, foundry sand 48 as well as molten metal (e.g. 8620 or 8640 steel) replacing the pattern assembly in the container 40 before, during, and after countergravity casting and to draw the molten metal into the pattern assembly to replace it. Foundry sand particulates 48 and molten steel replacing the pattern assembly 10 weighing a total of 240 pounds can be held in the container 40 by this vacuum level.

The container 40 typically is lowered relative to the pool of molten metal M by a suitable actuator (not shown) connected to arm 41 as described in the above U.S. Pat. No. 4 874 029 incorporated herein by reference. The rate of descent of the container 40 relative to the pool is controlled to assure that more molten metal M is displaced by compressed sand in the descending container 40 per unit of time than is drawn up into the pattern assembly 10 so as to prevent aspiration of air into the molten metal.

Figure 6:
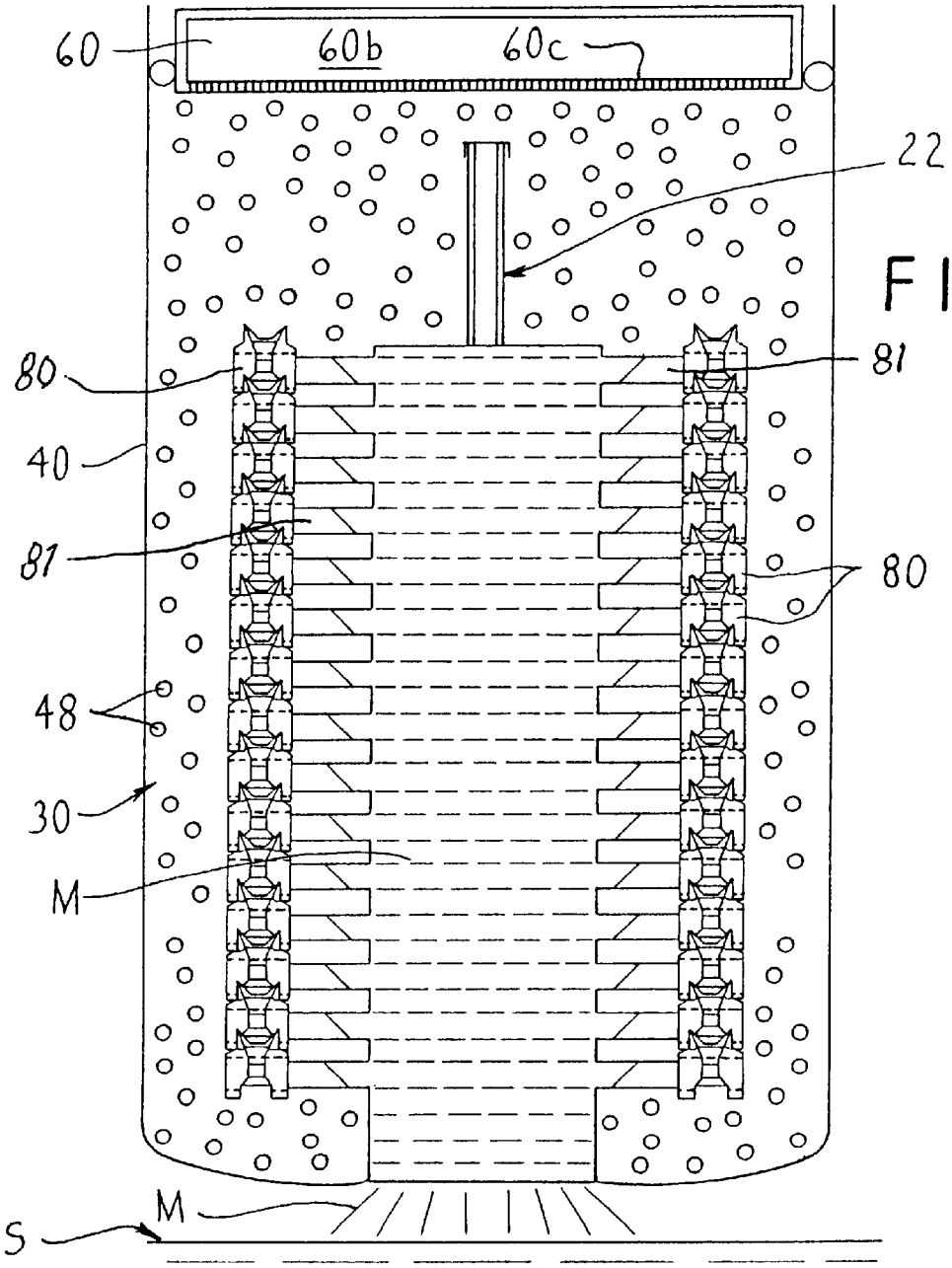
FIG. 6 is a similar view showing the container removed from the pool of molten metal to permit drainage of still molten metal in the sprue back to the pool.

After at least partial solidification of the castings replacing the patterns 16 and the runners 14 and with the metal replacing the sprue 12 still molten, the container 40 and source S of molten metal are relatively moved to disengage the container end 40*a* from the molten metal M with subambient pressure still present in chamber 60*b*, FIG. 6. Typically, the metal replacing the patterns 16 (forming castings 80) and solidified metal 81 occupying a portion of the runners 14 will be completely solidified before the container 40 is raised out of the molten metal M. Upon disengagement, molten metal replacing the pattern sprue 12 in the media 30 drains by gravity from the sprue to the underlying source S for reuse. The sprue 12 is sized such that the metal M replacing the sprue 12 remains molten for a time after the metal M replacing patterns 16 and a portion of runners 14 has solidified. The lateral dimension (e.g. diameter) of sprue 12 is selected to be at least two times greater than the largest dimension of the patterns 16 to this end.

The container 40 with the solidified castings 80 therein can be moved to a rotary shakeout table (not shown) where the subambient pressure in the container 40 is released (by providing ambient pressure via valve V in vacuum chamber 60*b*) so that the particulates 48 and castings fall onto the table for separation.

While the invention has been described in terms of specific embodiments thereof, it is not intended to be limited thereto but rather only to the extent set forth in the following claims.

We claim:

1. A method of casting a plurality of articles, comprising:

disposing particulates in an open bottom container around a plurality of vaporizable patterns of the articles to be cast, establishing a subambient pressure in said container, rotating said container with said subambient pressure therein about an axis to invert said container to an extent that causes movement of said particulates to regions of said patterns that are not yet invested by said particulates, and relatively moving the container and a-source of molten metal to draw molten metal from said source to said patterns to destroy and replace them.

2. The method of claim 1 wherein the container is rotated about an axis perpendicular to a longitudinal axis of a sprue connected to said patterns.

3. The method of claim 2 including rotating the container about a longitudinal axis of said container before or after said rotation about said axis.

4. The method of claim 1 including venting decomposition vapors of said patterns through a vent passage in a sprue connected to said patterns.

5. The method of claim 1 wherein said patterns comprise foam plastic having a density of about 1.8 to about 2.2 pounds per cubic foot.

6. The method of claim 5 wherein said patterns have at least one thin pattern wall having a wall thickness not exceeding 0.060 inch.

7. The method of claim 5 wherein said patterns are covered with a layer of refractory material and have a configuration to form rocker arm castings.

8. The method of claim 5 wherein said foam plastic comprises expanded polystyrene.

9. A method of casting a plurality of thin wall articles, comprising:

disposing particulates in an open bottom container around a vaporizable pattern assembly having a central pattern sprue connected to a plurality of thin wall patterns of articles to be cast, said particulates forming a bed in said container, evacuating said container to establish an external pressure on a bottom side of said bed exceeding internal pressure in said container, relatively moving the container and a source of molten metal to communicate said bottom side to said source, drawing molten metal through into the pattern assembly to destroy and replace in said bed including venting decomposition vapors of said pattern assembly to said bed through a vent passage in said pattern sprue, and relatively moving said container and said source of molten metal to disengage said bottom side from said source after said articles are at least partially solidified, including draining molten metal in said pattern sprue back to said source.

10. The method of claim 9 wherein said pattern assembly is a molded foam plastic having a density of about 1.8 to about 2.2 pounds per cubic foot.

11. The method of claim 10 wherein said patterns have at least one thin pattern wall having a wall thickness not exceeding 0.060 inch.

12. The method of claim 9 wherein said patterns have a configuration to form rocker arm castings.

13. The method of claim 9 wherein the foam plastic comprises expanded polystyrene.

14. The method of claim 9 including rotating the container after evacuation about an axis to invert said container to an extent that causes movement of said particulates to regions of said thin wall patterns that remain unsupported by particulates.

15. The method of claim 9 including communicating an open upper end of said vent passage with a vent tube that communicates to said bed proximate a vacuum chamber disposed atop said bed.

16. A countergravity casting apparatus, comprising:

a vaporizable pattern assembly having a sprue connected to a plurality of thin wall patterns of articles to be cast, said pattern assembly comprising a foam plastic pattern material having a density of about 1.8 to about 2.2 pounds per cubic foot, particulates disposed around said pattern assembly in a container, and said sprue having a vent passage communicated to said particulates.

17. The apparatus of claim 16 wherein each said pattern has at least one thin pattern wall having a wall thickness not exceeding 0.060 inch.

18. The apparatus of claim 17 wherein each said pattern has a configuration to form a rocker arm casting.

19. The apparatus of claim 16 wherein the foam plastic comprises expanded polystyrene.

20. The apparatus of claim 16 including a vent tube communicating with an open upper end of said vent passage and to said particulates proximate a vacuum chamber disposed atop said particulates.

* * * * *

UNITED STATES PATENT AND TRADEMARK OFFICE

CERTIFICATE OF CORRECTION

PATENT NO. : 6,453,976 B1 
DATED : September 24, 2002
INVENTOR(S) : George D. Chandley et al.

It is certified that error appears in the above-identified patent and that said Letters Patent is hereby corrected as shown below:

Column 7,
Line 40, delete "-".

Signed and Sealed this

Eighteenth Day of February, 2003

JAMES E. ROGAN
*Director of the United States Patent and Trademark Office*